US009805648B2

(12) United States Patent
Kim et al.

(10) Patent No.: US 9,805,648 B2
(45) Date of Patent: Oct. 31, 2017

(54) AMOLED DISPLAY DEVICE INCLUDING COMPENSATON UNIT AND DRIVING METHOD THEREOF

(71) Applicant: Samsung Display Co., Ltd., Yongin, Gyeonggi-Do (KR)

(72) Inventors: Bo Yeon Kim, Seoul (KR); Oh Jo Kwon, Suwon-si (KR); Choong Sun Shin, Yongin-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 170 days.

(21) Appl. No.: 14/253,725

(22) Filed: Apr. 15, 2014

(65) Prior Publication Data

US 2015/0077314 A1 Mar. 19, 2015

(30) Foreign Application Priority Data

Sep. 13, 2013 (KR) ..... 10-2013-0110680

(51) Int. Cl.
*G09G 3/3233* (2016.01)

(52) U.S. Cl.
CPC ... *G09G 3/3233* (2013.01); *G09G 2300/0842* (2013.01); *G09G 2320/045* (2013.01)

(58) Field of Classification Search
CPC ..... G09G 2300/0842; G09G 2320/045; G09G 3/3233
See application file for complete search history.

(56) References Cited

U.S. PATENT DOCUMENTS

| | | | | |
|---|---|---|---|---|
| 7,423,617 | B2 * | 9/2008 | Giraldo | G09G 3/006 345/100 |
| 7,486,100 | B2 | 2/2009 | Sakaguchi et al. | |
| 7,893,895 | B2 | 2/2011 | Uchino et al. | |
| 8,115,707 | B2 | 2/2012 | Nathan et al. | |
| 8,120,601 | B2 | 2/2012 | Shirasaki et al. | |
| 8,217,928 | B2 | 7/2012 | Levey et al. | |
| 2005/0052377 | A1 * | 3/2005 | Hsueh | G09G 3/3233 345/82 |
| 2010/0277400 | A1 * | 11/2010 | Jeong | G09G 3/3275 345/76 |

(Continued)

FOREIGN PATENT DOCUMENTS

| | | | |
|---|---|---|---|
| KR | 10-0712678 | B1 | 4/2007 |
| KR | 10-2011-0032937 | A | 3/2011 |

*Primary Examiner* — Ram Mistry
(74) *Attorney, Agent, or Firm* — Knobbe, Martens, Olson & Bear, LLP

(57) ABSTRACT

A display device is disclosed. In one aspect, the display device includes a plurality of pixels, a plurality of data lines respectively connected to the pixels, and a compensation unit connected to at least one the data lines. The compensation unit includes a first capacitor storing a leakage current of a pixel connected to the data line, a second capacitor storing a difference current, where the difference current is the difference between a reference current and a pixel current measured when a data signal of a reference gray signal is applied to the pixel. The compensation unit also includes a comparator outputting a difference value between the voltages stored in the first and second capacitors. According to embodiments, is possible to measure an accurate pixel current regardless of a leakage current and accurately detect deterioration of a pixel.

15 Claims, 8 Drawing Sheets

(56) References Cited

U.S. PATENT DOCUMENTS

| | | | | |
|---|---|---|---|---|
| 2011/0130981 | A1 | 6/2011 | Chaji et al. | |
| 2012/0188150 | A1* | 7/2012 | Shirouzu | G09G 3/3233 345/76 |
| 2013/0050292 | A1 | 2/2013 | Mizukoshi | |
| 2014/0198092 | A1* | 7/2014 | Azizi | G09G 3/006 345/212 |

* cited by examiner

AMOLED DISPLAY DEVICE INCLUDING COMPENSATON UNIT AND DRIVING METHOD THEREOF

CROSS-REFERENCE TO RELATED APPLICATIONS

This application claims priority to and the benefit of Korean Patent Application No. 10-2013-0110680 filed in the Korean Intellectual Property Office on Sep. 13, 2013, the entire contents of which are incorporated herein by reference.

BACKGROUND

Field

The described technology generally relates to a display device and a driving method thereof.

Description of the Related Technology

Organic light-emitting diode (OLED) displays use OLEDs in which luminance is controlled by a current or a voltage. OLEDs generally include an anode layer and a cathode layer for generating an electric field, and an organic light-emitting material which can emit light due to the electric field.

OLED displays can be classified into passive matrix OLED (PMOLED) and active matrix OLED (AMOLED) displays according to their driving method.

The use of AMOLED displays has become widespread since these displays can emit light for each unit pixel with a favorable resolution, contrast, and refresh rate.

Due to their use of organic materials, OLEDs degrade over time. The amount of light emitted in a degraded OLED can vary over an initial driving period due to variation in pixel current. Accordingly, image quality of an OLED display degrades with time.

SUMMARY OF CERTAIN INVENTIVE ASPECTS

One inventive aspect is a display device and a driving method thereof capable of accurately measuring a pixel current.

Another aspect is a display device and a driving method thereof having the advantages of accurately detecting the degradation of a pixel by measuring an accurate pixel current regardless of a leakage current.

Another aspect is a display device including a plurality of pixels, a plurality of data lines respectively connected to the pixels, and a compensation unit connected to at least one of the data lines, in which the compensation unit includes a first capacitor storing a leakage current of the data line, a second capacitor storing a difference current obtained by subtracting a reference current from a pixel current measured when a data signal of a reference gray signal is applied to the data line, and a comparator outputting a difference value between the voltages stored in the first and second capacitors.

The compensation unit may further include a first transistor including a gate electrode connected to a first node, a first electrode connected to a high level voltage, and a second electrode connected to a second node, a second transistor including a gate electrode connected to the first node, a first electrode connected to the second node, and a second electrode connected to a third node, and a third transistor including a gate electrode receiving a first switching control signal, a first electrode connected to the data line, and a second electrode connected to the second node, in which the first and second capacitors may be connected to the third node.

The first transistor may be a p-channel field effect transistor and the second transistor may be an n-channel field effect transistor.

The degradation compensating unit may further include a first differential amplifier including a first input terminal connected to the second node, a second input terminal receiving a reference voltage, and an output terminal connected to the first node.

The compensation unit may further include a fourth transistor including a gate electrode receiving a second switching control signal, a first electrode, and a second electrode connected to the third node, and a second differential amplifier including a first input terminal receiving a reset voltage, a second input terminal connected to the first electrode of the fourth transistor, and an output terminal connected to the first electrode of the fourth transistor.

The compensation unit may further include a sixth transistor including a gate electrode receiving a fourth switching control signal, a first electrode connected to the third node, and a second electrode connected to the first capacitor.

The compensation unit may further include a seventh transistor including a gate electrode receiving a fifth switching control signal, a first electrode connected to the third node, and a second electrode connected to the second capacitor.

The comparator may include a first input terminal connected to the second capacitor, a second input terminal connected to the first capacitor, and an output terminal outputting the difference value.

The compensation unit may further include a fifth transistor including a gate electrode receiving a third switching control signal, a first electrode connected to the third node, and a second electrode, and a bias circuit connected between the second electrode of the fifth transistor and ground, and controlling a predetermined current to flow from the third node to the ground when the fifth transistor is turned on.

The reference voltage may be a voltage corresponding to an operation point of an OLED included in the pixel connected to the data line.

The predetermined current may be substantially the same as a reference current flowing through a driving transistor included in the pixel when applied with the data signal of the reference gray signal.

A plurality of compensation units may be provided and be respectively connected to the data lines.

The display device may further include a multiplexor (MUX) selectively connecting the compensation unit to the data lines.

The compensation unit may further include a fifth transistor including a gate electrode receiving a third switch control signal, a first electrode connected to the high level voltage, and a second electrode, and a bias circuit connected between the second electrode of the fifth transistor and the second node to control a predetermined current to flow from the high level voltage to the second node when the fifth transistor is turned on.

The reference voltage may be a voltage lower than an operation point of the OLED included in the pixel connected to the corresponding data line.

Another aspect is a method of driving a display device including charging a parasitic capacitor of a data line to a reference voltage, storing a leakage current flowing from the data line in a first capacitor, applying a data signal having a predetermined reference gray signal to the pixel connected to the data line, measuring a current flowing from the pixel while the predetermined reference gray signal is applied to the pixel, storing a difference current obtained by subtracting a reference current from the measured current in a second capacitor, and outputting a difference value between the voltages stored in the first and second capacitors.

The method may further include resetting the voltages of the first and second capacitors to a reset voltage before the charging of the parasitic capacitor.

The reference voltage may be a voltage corresponding to an operation point of an OLED included in the pixel.

The reference voltage may be a voltage lower than an operation point of an OLED included in the pixel.

The charging of the difference current may include applying the reference voltage as a voltage at which the OLED emits light at the predetermined reference gray signal.

Another aspect is a display device including a plurality of pixels, a compensation unit connected to at least one of the pixels and configured to output degradation information, and a signal controller configured to control the pixels based at least in part on the degradation information, wherein the compensation unit is further configured to measure a leakage current and a difference current of the pixel, wherein the difference current is defined as the difference between a reference current and a current of the pixel measured when a data signal having a predetermined gray is applied to the pixel, and wherein the compensation unit is further configured to generate the degradation information based on at least one of the leakage current or the difference current.

The compensation unit may include a first capacitor configured to store the leakage current, a second capacitor configured to store the difference current, and a comparator configured to compare the leakage current and the difference current, and output the difference as the degradation information.

The compensation unit may further include a first transistor including a gate electrode connected to a first node, a first electrode connected to a high level voltage, and a second electrode connected to a second node, a second transistor including a gate electrode connected to the first node, a first electrode connected to the second node, and a second electrode connected to a third node, and a third transistor including a gate electrode configured to receive a first switching control signal, a first electrode connected to a corresponding data line, and a second electrode connected to the second node, wherein the first and second capacitors are connected to the third node.

According to at least one embodiment, it is possible to measure a pixel current accurately regardless of a leakage current as well as accurately detect the degradation of a pixel.

DETAILED DESCRIPTION OF CERTAIN INVENTIVE EMBODIMENTS

Figure 1:
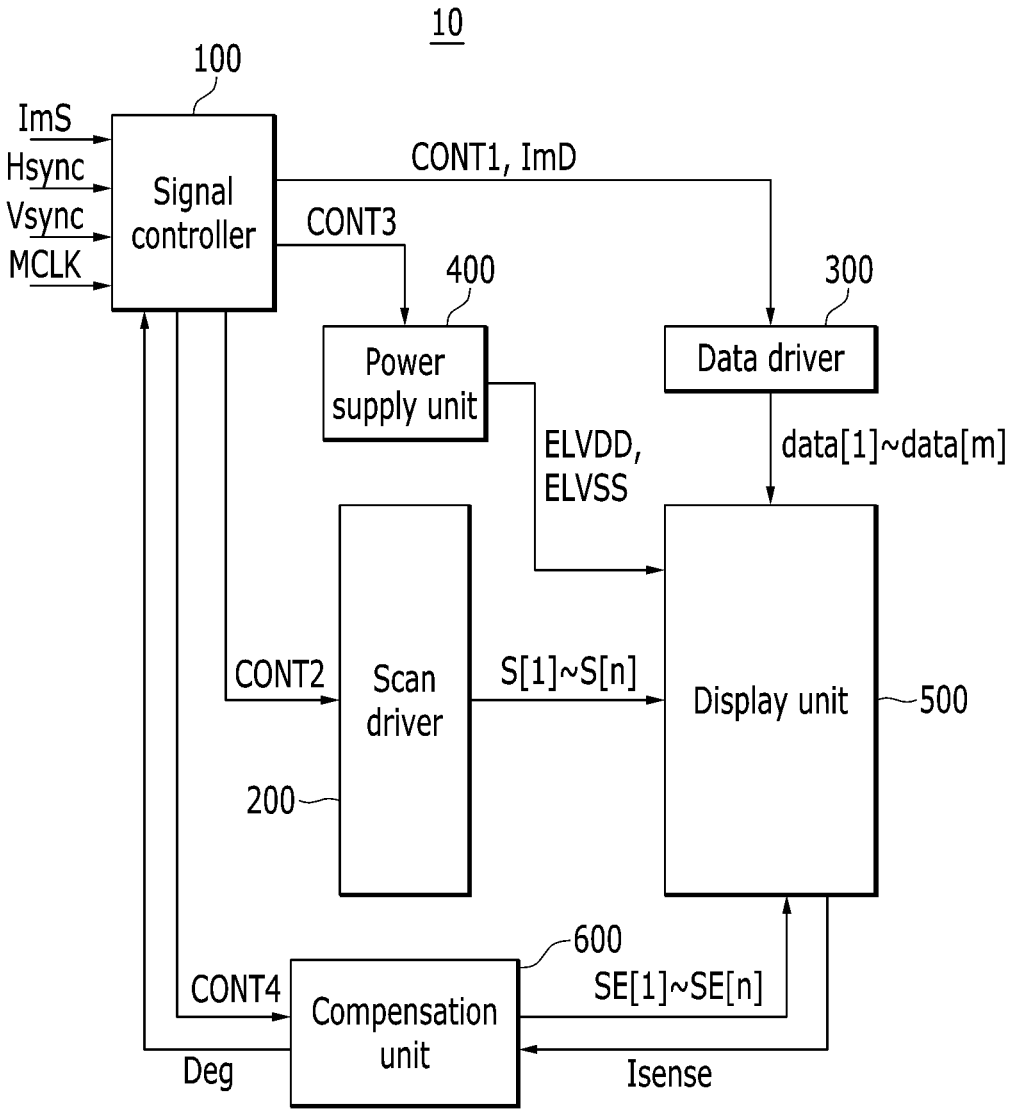
FIG. 1 is a block diagram illustrating a display device according to an exemplary embodiment.

Various methods for compensating aged OLEDs have been developed. One step of these methods includes measuring a pixel current. Generally, when measuring pixel current, leakage current is included in the measured current. An accurate pixel current can be measured by compensating for the leakage current in the measured current, however, it is not easy to accurately measure leakage current.

Additionally, larger OLED displays are being developed, and as a result, the resistance and capacitance of components of the display increases. Consequently, the time required to measure the pixel current increases. Finally, it can be difficult to accurately detect the light emitting capability of an OLED based only on measuring the pixel current.

The described technology will be described more fully hereinafter with reference to the accompanying drawings, in which exemplary embodiments of the described technology are shown. As those skilled in the art would realize, the described embodiments may be modified in various different ways, all without departing from the spirit or scope of the described technology.

Further, in exemplary embodiments, since like reference numerals designate like elements having the same configuration, a first exemplary embodiment is representatively described, and in other exemplary embodiments, only those configurations different from the first exemplary embodiment will be described.

The drawings and description are to be regarded as illustrative in nature and not restrictive, and like reference numerals designate like elements throughout the specification.

Throughout this specification and the claims that follow, when it is described that an element is "coupled" or "connected" to another element, the element may be "directly coupled" or "directly connected" to the other element or "coupled" or "connected" to the other element through a third element. As used herein, the term "connected" includes the term "electrically connected." In addition, unless explicitly described to the contrary, the word "comprise" and variations such as "comprises" or "comprising," will be understood to imply the inclusion of stated elements but not the exclusion of any other elements.

FIG. 1 is a block diagram illustrating a display device according to an exemplary embodiment.

Referring to FIG. 1, a display device 10 includes a signal controller 100, a scan driver 200, a data driver 300, a power supply unit (or power supply) 400, a display unit (or display panel) 500, and a compensation unit 600.

The signal controller 100 receives an image signal ImS and a synchronization signal from an external device. The image signal ImS includes luminance information for a plurality of pixels. The luminance has a predetermined number of grays, for example, 1024($=2^{10}$), 256($=2^{8}$) or 64($=2^{6}$) grays. The synchronization signal includes a horizontal synchronization signal Hsync, a vertical synchronization signal Vsync, and a main clock signal MCLK.

The signal controller 100 generates first to fourth driving control signals CONT1 to CONT4 and an image data signal ImD according to the image signal ImS, the horizontal synchronization signal Hsync, the vertical synchronization signal Vsync, and the main clock signal MCLK. The signal controller 100 divides the image signal ImS by a frame unit according to the vertical synchronization signal Vsync and divides the image signal ImS by a scan line unit according to the horizontal synchronization signal Hsync to generate image data ImD. The signal controller 100 transfers the image data ImD to the data driver 300 together with the first driving control signal CONT1.

The display unit 500 is a display area including a plurality of pixels. In the display unit 500, a plurality of scan lines extended in a row direction to be substantially parallel to each other and a plurality of data lines extended in a column direction to be substantially parallel to each other. The display unit 500 also includes a plurality of sensing lines extended in a row direction to be substantially parallel to each other and a plurality of power lines are formed to be connected to the pixels. The pixels are arranged in a matrix arrangement.

The scan driver 200 is connected to the scan lines to generate a plurality of scanning signals S[1] to S[n] according to the second driving control signal CONT2. The scan driver 200 sequentially applies the scanning signals S[1] to S[n] including gate-on voltages to the scan lines.

The data driver 300 is connected to the data lines to sample and hold the image data ImD according to the first driving control signal CONT1 and respectively apply a plurality of data signals data[1] to data[m] to the data lines. The data driver 300 may apply the data signals data[1] to data[m] having a predetermined voltage range to the data lines in response to the scanning signals S[1] to S[n].

The power supply unit 400 determines the levels of a first power voltage ELVDD and a second power voltage ELVSS according to a third driving control signal CONT3 and supplies the first and second power voltages ELVDD and ELVSS to the power lines connected to the pixels. The first and second power voltages ELVDD and ELVSS provide driving currents to the pixels.

The compensation unit 600 is connected to the sensing lines and generates a plurality of sensing signals SE[1] to SE[n] according to a fourth driving control signal CONT4. The compensation unit 600 sequentially applies the sensing signals SE[1] to SE[n] having gate-on voltages. The compensation unit 600 is connected to the data lines to measure a measured current Isense flowing through the data lines.

According to some embodiments, the data driver 300 is connected to one end of the data lines and the compensation unit 600 is connected to the other end of the data lines.

The compensation unit 600 measures the respective degree of degradation for each of the pixels by using the measured current Isense and transfers degradation information Deg indicating the degree of degradation to the signal controller 100.

The signal controller 100 reflects the degradation information Deg of the pixels in generating the image data ImD.

The aforementioned driving devices 100, 200, 300, 400, and 600 may be directly installed on the display unit 500 in at least one IC chip form, installed on a flexible printed circuit film, attached to the display unit 500 in a tape carrier package (TCP) form, installed on a separate printed circuit board (PCB), or integrated on the display unit 500.

Figure 2:
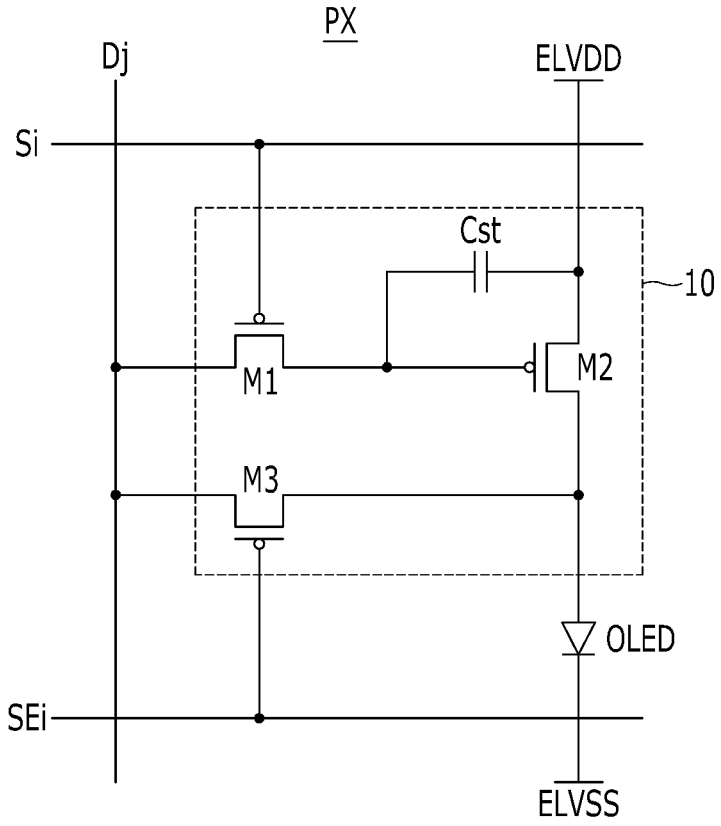
FIG. 2 is a circuit diagram illustrating a pixel according to an exemplary embodiment.

FIG. 2 is a circuit diagram illustrating a pixel according to an exemplary embodiment.

Referring to FIG. 2, a pixel PX positioned in an i-th row and a j-th column from among the pixels included in the display device 10 is illustrated ($1 \le i \le n$, $1 \le j \le m$).

The pixel PX includes an organic light-emitting diode (OLED) and a pixel circuit 10 for controlling the OLED. The pixel circuit 10 includes a switching transistor M1, a driving transistor M2, a sensing transistor M3, and a storage capacitor Cst.

The switching transistor M1 includes a gate electrode connected to the scan line Si, one end connected to the data line Dj, and another end connected to the gate electrode of the driving transistor M2.

The driving transistor M2 includes a gate electrode connected to the other end of the switching transistor M1, one end connected to the first power voltage ELVDD, and another end connected to the OLED.

The sensing transistor M3 includes a gate electrode connected to the sensing line SEi, one end connected to the other end of the driving transistor M2, and another end connected to the data line Dj.

The storage capacitor Cst includes one end connected to the gate electrode of the driving transistor M2 and another end connected to the first power voltage ELVDD. The storage capacitor Cst is charged with a data voltage applied to the gate electrode of the driving transistor M2 and maintains the charged data voltage even after the switching transistor M1 is turned off.

The OLED includes an anode connected to the other end of the driving transistor M2 and a cathode connected to the second power voltage ELVSS. The OLED includes an organic emission layer which emits light having a primary color. An example of the primary colors may include three primary colors such as red, green, and blue, and a desired color may be displayed by a spatial or temporal sum of the three primary colors.

The organic emission layer may be made of a low-molecular organic material or a high-molecular organic material such as poly 3,4-ethylenedioxythiophene (PEDOT). Further, the organic emission layer may be formed as a multilayer including a light emitting layer, and one or more of a hole injection layer (HIL), a hole transporting layer (HTL), an electron transporting layer (ETL), and an electron injection layer (EIL). In the case where the organic emission layer includes all of the layers, the hole injection layer (HIL) is disposed on a pixel electrode which is an anode, and the hole transporting layer (HTL), the light emitting layer, the electron transporting layer (ETL), and the electron injection layer (EIL) are sequentially laminated thereon.

The organic emission layer may include a red organic emission layer emitting red light, a green organic emission layer emitting green light, and a blue organic emission layer emitting blue light. The red, green, and blue organic emission layers are respectively formed in red, green, and blue pixels, thereby implementing a color image.

Further, the organic emission layer may implement the color image by laminating each of the red, green, and blue organic emission layers together in each of the red, green, and blue pixels, and respectively forming red, green, and blue color filters for each pixel. As another example, white organic emission layers emitting white light are formed in each the red, green, and blue pixels and red, green, and blue color filters are respectively formed for each pixel, thereby implementing the color image. In this case, a deposition mask for respectively depositing each of the red, green, and blue organic emission layers in the corresponding pixels is not required.

The white organic emission layer described in another example may be formed as a single organic emission layer or may include a configuration formed so as to emit white light by laminating a plurality of organic emission layers.

For example, the white organic emission layer may include a configuration which may emit white light by combining at least one of each of yellow and blue organic emission layers, a configuration which may emit white light by combining at least one of each of cyan and red organic emission layers, a configuration which may emit white light by combining at least one of each of magenta and green organic emission layers, and the like.

Each of the switching, driving, and sensing transistors M1 to M3 may be p-channel field effect transistors. In this case, the gate-on voltages turning on each of the switching driving and sensing transistors M1 to M3 are low level voltages and the gate-off voltages turning off each of the transistors are high level voltages.

Herein, p-channel field effect transistors are illustrated, but at least one of the switching driving or sensing transistors M1 to M3 may be an n-channel field effect transistor. In this case, the gate-on voltage turning on the n-channel field effect transistor is a high level voltage, and the gate-off voltage turning off the n-channel field effect transistor is a low level voltage.

When the scanning signal S [i] of the gate-on voltage is applied to the scan line Si, the switching transistor M1 is turned on, and the data signal applied to the data line Dj is applied to one end of the storage capacitor Cst through the turned-on switching transistor M1 to charge the storage capacitor Cst. The driving transistor M2 controls a pixel current which flows from the first power voltage ELVDD to the OLED in response to the voltage charged in the storage capacitor Cst. The OLED emits light corresponding to magnitude of the pixel current flowing through the driving transistor M2.

During normal driving when the display device 10 displays an image, the sensing signal SE[i] of the gate-off voltage is applied to the sensing line SEi and the sensing transistor M3 is turned off.

Meanwhile, during compensation driving when the display device 10 measures the pixel current of each of the pixels PX in order to compensate for the degradation of the pixels PX, the sensing signal SE[i] of the gate-on voltage is applied to the sensing line SEi and the sensing transistor M3 is turned on. The pixel current flows to the data line Dj through the turned-on sensing transistor M3.

Figure 3:
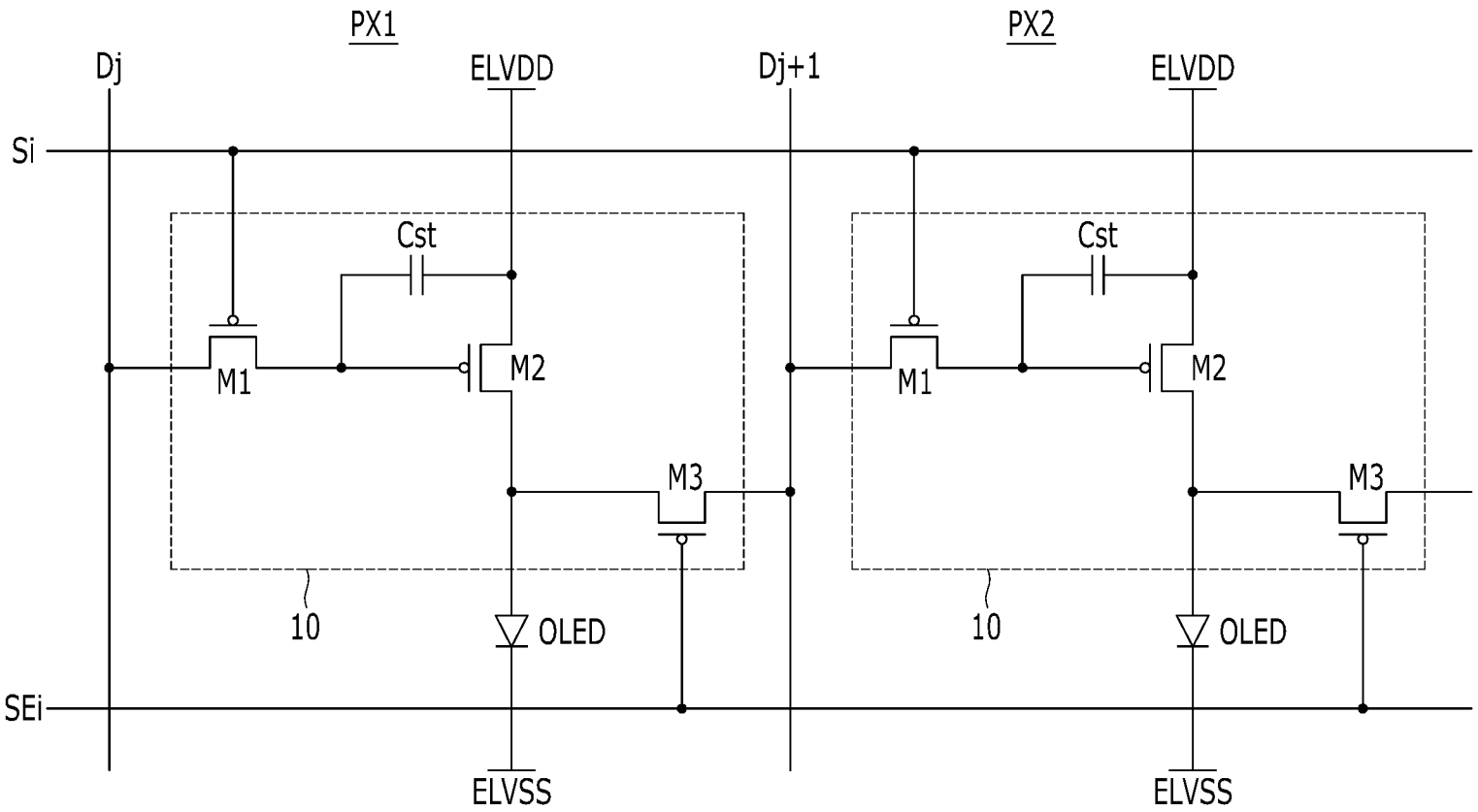
FIG. 3 is a circuit diagram illustrating a pixel according to another exemplary embodiment.

FIG. 3 is a circuit diagram illustrating a pixel according to another exemplary embodiment.

Referring to FIG. 3, among the pixels included in the display device 10, a first pixel PX1 positioned in an i-th row and a j-th column and a second pixel PX2 positioned in the i-th row and a j+1-th column are illustrated ($1 \le i \le n$, $1 \le j \le m-1$).

In contrast to the embodiment of FIG. 2, the sensing transistor M3 of this circuit is not connected between the driving transistor M2 and the data line Dj applying the data signal to the corresponding pixel; but the sensing transistor M3 is connected between the driving transistor M2 and a data line Dj+1 applying a data signal to an adjacent pixel.

That is, the sensing transistor M3 includes a gate electrode connected to the sensing line SEi, one end connected to the other end of the driving transistor M2, and another end connected to the data line Dj+1 of the adjacent pixel.

Due to this configuration, during compensation driving of the display device 10, the sensing signal SE[i] of the gate-on voltage is applied to the sensing line SEi and thus the pixel current flows to the data line Dj+1 of the adjacent pixel through the turned-on sensing transistor M3.

Since other constituent elements are the same as those described in FIG. 2, descriptions thereof will be omitted.

The aforementioned pixels in FIGS. 2 and 3 represent exemplary embodiments of the structure of the pixels and a proposed degradation compensating method is not limited to the structure of the pixels. The display device 10 may include pixels having various structures and the proposed degradation compensating method may be applied to a display device 10 including pixels having various structures.

Hereinafter, a detailed configuration and an operation of the compensation unit 600 will be described.

Figure 4:
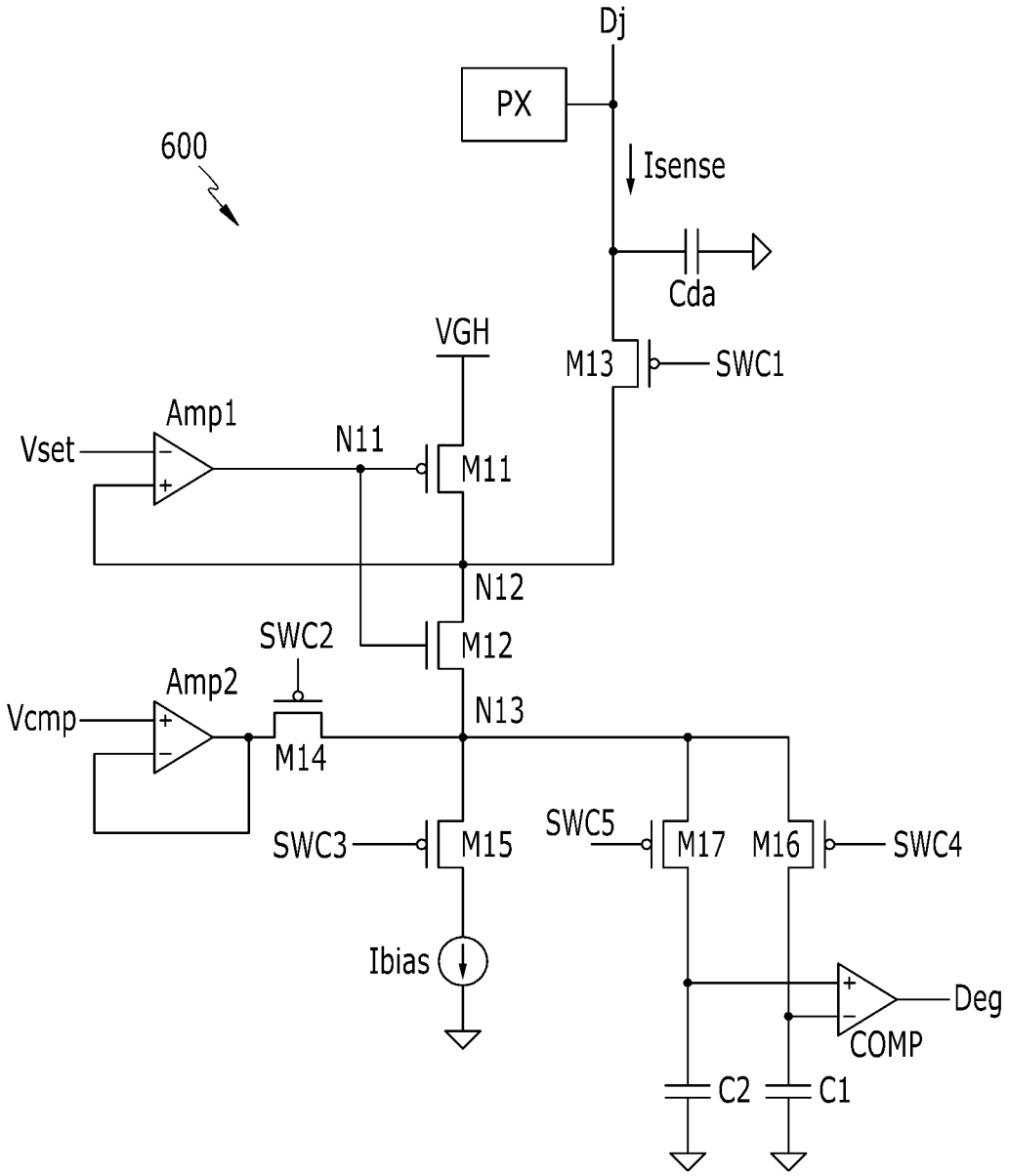
FIG. 4 is a circuit diagram illustrating a compensation unit according to an exemplary embodiment.

FIG. 4 is a circuit diagram illustrating a compensation unit according to an exemplary embodiment.

Referring to FIG. 4, the compensation unit 600 includes a plurality of transistors M11 to M17, a first differential amplifier Amp1, a second differential amplifier Amp2, a bias circuit Ibias, a first capacitor C1, a second capacitor C2, and a comparator COMP.

The first transistor M11 includes a gate electrode connected to a first node N11, one electrode connected to a high level voltage VGH, and another electrode connected to a second node N12.

The second transistor M12 includes a gate electrode connected to the first node N11, one electrode connected to the second node N12, and another electrode connected to a third node N13.

The third transistor M13 includes a gate electrode receiving a first switching control signal SWC1, one electrode connected to the data line Dj, and another electrode connected to the second node N12.

The fourth transistor M14 includes a gate electrode receiving a second switching control signal SWC2, one electrode connected to an output terminal of the second differential amplifier Amp2, and another electrode connected to the third node N13.

The fifth transistor M15 includes a gate electrode receiving a third switching control signal SWC3, one electrode connected to the third node N13, and another electrode connected to the bias circuit Ibias.

The sixth transistor M16 includes a gate electrode receiving a fourth switching control signal SWC4, one electrode connected to the third node N13, and another electrode connected to the first capacitor C1.

The seventh transistor M17 includes a gate electrode receiving a fifth switching control signal SWC5, one electrode connected to the third node N13, and another electrode connected to the second capacitor C2.

The first differential amplifier Amp1 includes a first input terminal (+) connected to the second node N12, a second input terminal (−) receiving a reference voltage Vset, and an output terminal connected to the first node N11.

The second differential amplifier Amp2 includes a first input terminal (+) receiving a reset voltage Vcmp, a second input terminal (−) connected to the one electrode of the fourth transistor M14, and an output terminal connected to the one electrode of the fourth transistor M14.

The bias circuit Ibias is connected between the other electrode of the fifth transistor M15 and a ground, and generates a predetermined current which flows from the third node N13 to the ground when the fifth transistor M15 is turned on.

The first capacitor C1 includes one electrode connected to the other electrode of the sixth transistor M16 and the other electrode connected to the ground.

The second capacitor C2 includes one electrode connected to the other electrode of the seventh transistor M17 and the other electrode connected to the ground.

The comparator COMP includes a first input terminal (+) connected to the one electrode of the second capacitor C2, a second input terminal (−) connected to the one electrode of the first capacitor C1, and an output terminal outputting the degradation information Deg.

The first transistor M11 may be a p-channel field effect transistor, and the second transistor M12 may be an n-channel field effect transistor. Alternatively, when the first transistor M11 is an n-channel field effect transistor, the second transistor M12 may be a p-channel field effect transistor. The other transistors M13 to M17 may be p-channel field effect transistors. Alternatively, the other transistors M13 to M17 may be n-channel field effect transistors. A gate-on voltage turning on the p-channel field effect transistor is a low level voltage, and a gate-off voltage turning off the p-channel field effect transistor is a high level voltage. A gate-on voltage turning on the n-channel field effect transistor is a high level voltage, and a gate-off voltage turning off the n-channel field effect transistor is a low level voltage.

The transistors M11 to M17 may be oxide thin film transistors (oxide TFTs) in which semiconductor layers are made of oxide semiconductors.

The oxide semiconductor may include one of an oxide based on titanium (Ti), hafnium (Hf), zirconium (Zr), aluminum (Al), tantalum (Ta), germanium (Ge), zinc (Zn), gallium (Ga), tin (Sn) or indium (In), and complex oxides thereof such as zinc oxide (ZnO), indium-gallium-zinc oxide ($InGaZnO_4$), indium zinc oxide (In—Zn—O), zinc-tin oxide (Zn—Sn—O), indium gallium oxide (In—Ga—O), indium-tin oxide (In—Sn—O), indium-zirconium oxide (In—Zr—O), indium-zirconium-zinc oxide (In—Zr—Zn—O) indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Th—Ga—O), indium-germanium oxide (In—Ge—O), indium-germanium-zinc oxide (In—Ge—Zn—O), indium-germanium-tin oxide (In—Ge—Sn—O), indium-germanium gallium oxide (In—Ge—Ga—O), titanium-indium-zinc oxide (Ti—In—Zn—O), and hafnium-indium-zinc oxide (Hf—In—Zn—O).

The semiconductor layer includes a channel region in which impurities are not doped, and a source region and a drain region formed when impurities are doped in two sides of the channel region. Herein, the impurities vary according to a kind of the thin film transistor, and may be N-type impurities or P-type impurities.

In the case where the semiconductor layer is formed of an oxide semiconductor, in order to protect the oxide semiconductor which may be vulnerable to ambient environmental conditions, or when exposed to a high temperature, a separate passivation layer may be added.

Next, the operation of the compensation unit 600 will be described. The compensation unit 600 may generate the first to fifth switching control signals SWC1 to SWC5 according to a fourth driving control signal CONT4 applied from the signal controller 100.

For a first period, the second fourth, and fifth switching control signals SWC2, SWC4, and SWC5 are applied as the gate-on voltage. In this case, the first and third switching control signals SWC1 and SWC3 are applied as the gate-off voltage. The fourth, sixth, and seventh transistors M14, M16, and M17 are turned on. When the fourth transistor M14 is turned on, the second differential amplifier Amp2 is enabled. Accordingly, the first capacitor C1 is charged by the reset voltage Vcmp through the turned-on sixth transistor M16, and the second capacitor C2 is charged by the reset voltage Vcmp through the turned-on seventh transistor M17. The first period may be a period for resetting the first and second capacitors C1 and C2 to the reset voltage Vcmp.

For a second period, the second, fourth, and fifth switching control signals SWC2, SWC4, and SWC5 are applied as the gate-off voltage, and the first and third switching control signals SWC1 and SWC3 are applied as the gate-on voltage. In this case, the sensing signal SE[i] of the gate-on voltage may be applied to the gate electrode of the sensing transistor M3 included in the pixel PX connected to the data line Dj. In addition, a data signal having a voltage corresponding to an operation point of the OLED may be applied to the gate electrode of the driving transistor M2. The operation point refers to the minimum current or voltage at which the OLED begins to emit light. For example, a data signal of a black gray level may be applied to the gate electrode of the driving transistor M2. Further, a data signal of a predetermined gray level higher than black can also be applied to the gate electrode of the driving transistor M2.

As the first and third switching control signals SWC1 and SWC3 are turned on, the voltage of the second node N12 becomes the reference voltage Vset. The voltage of the second node N12 is stored in a parasitic capacitor Cda of the data line Dj. The reference voltage Vset is a voltage corresponding to an operation point of the OLED included in the pixel PX. That is, the parasitic capacitor Cda of the data line Dj is charged by the voltage corresponding to an operation point of the OLED.

For example, in the case where the voltage of the second node N12 is lower than the reference voltage Vset, a low level voltage is output from the first differential amplifier Amp1 to the first node N11. When the voltage of the first node N11 becomes the low level voltage, the first transistor M11 is turned on, and the current flows from the high level voltage VGH to the second node N12 through the turned-on first transistor M11. The voltage of the second node N12 then rises by the current flowing through the first transistor M11.

In the case where the voltage of the second node N12 is higher than the reference voltage Vset, a high level voltage is output from the first differential amplifier Amp1 to the first node N11. When the voltage of the first node N11 becomes the high level voltage, the second transistor M12 is turned on, and the current flows from the second node N12 to the third node N13 through the turned-on second transistor M12. Since fifth transistor M15 is turned on by the third switching control signal SWC3, a predetermined current flows from the third node N13 to ground due to the bias circuit Ibias. In other words, the bias circuit Ibias controls the predetermined current to flow from the third node N13 to ground. That is, current flows from the second node N12 to ground and the voltage of the second node N12 drops.

After the voltage of the second node N12 becomes the reference voltage Vset, both the first transistor M11 and the second transistor M12 are turned off. As a result, the voltage of the second node N12 becomes the reference voltage Vset and the parasitic capacitor Cda of the data line Dj is charged by the reference voltage Vset. Thus, the second period may be a period for pre-charging the parasitic capacitor Cda of the data line Dj by the reference voltage Vset which is the voltage corresponding to the operation point of the OLED.

For a third period, the first and fourth switching control signals SWC1 and SWC4 are applied as the gate-on voltage. In this case, the second, third, and fifth switching control signals SWC2, SWC3, and SWC5 are applied as the gate-off voltage. The third and sixth transistors M13 and M16 are turned on. A leakage current I_leak in the data line Dj or the pixel PX flows to the second node N12 through the turned-on third transistor M13 and the voltage of the second node N12 set as the reference voltage Vset in the second period rises by the leakage current I_leak. When the voltage of the second node N12 rises by the leakage current I_leak, the second transistor M12 is turned on to allow the flow of current. The current flowing through the second transistor M12 charges the first capacitor C1 through the turned-on sixth transistor M16. That is, the first capacitor C1 is charged by the leakage current I_leak. After a predetermined sampling period in the third period, the fourth switching control signal SWC4 is applied as the gate-off voltage and a charge corresponding to the leakage current I_leak is maintained in the first capacitor C1. The third period may be a period for charging the first capacitor C1 by the leakage current I_leak.

For a fourth period, the first, third, and fifth switching control signals SWC1, SWC3, and SWC5 are applied as the gate-on voltage. In this case, the second and fourth switching control signals SWC2 and SWC4 are applied as the gate-off voltage. In addition, the data signal of a predetermined reference gray signal is applied to the gate electrode of the driving transistor M2 included in the pixel PX and the sensing signal SE[i] of the gate-on voltage is applied to the gate electrode of the sensing transistor M3. The pixel current flowing through the turned-on driving transistor M2 due to the data signal of the reference gray signal is applied to the data line Dj as the measured current Isense through the turned-on sensing transistor M3.

The measured current Isense flows to the second node N12 through the turned-on third transistor M13. The voltage of the second node N12 rises by the measured current Isense and the second transistor M12 is turned on in response to the rising voltage and thus current flows from the second node N12 to the third node N13. The current flowing from the second node N12 to the third node N13 is the same as the measured current Isense. That is, the measured current Isense flows to the third node N13 through the second transistor M12. The fifth transistor M15 is turned on by the third switching control signal SWC3 and a predetermined current amount flows from the third node N13 to the ground due to the bias circuit Ibias. The bias circuit Ibias may be configured to have substantially the same current as a reference current Iref flowing through the turned-on driving transistor M2 by the data signal of the reference gray signal. From the measured current Isense flowing to the third node N13, the current amount corresponding to the reference current Iref flows to ground through the bias circuit Ibias and the difference current Idif (=Isense−Iref) acquired by subtracting the reference current Iref from the measured current Isense is stored in the second capacitor C2. After a predetermined sampling period in the fourth period, the fifth switching control signal SWC5 is applies as the gate-off voltage and a charge corresponding to the difference current Idif is maintained in the second capacitor C2. The sampling period of the third period and the sampling period of the fourth period may be set to the same period. The fourth period may be a period for charging the second capacitor C2 by the difference current Idif.

For a fifth period, the difference value between the voltages stored in the first and second capacitors C1 and C2 is output as the degradation information Deg through the comparator COMP. The leakage current I_leak is included in the measured current Isense. That is, the measured current Isense may be the sum of a pixel current Iref' flowing in the driving transistor M2 due to the data signal of the reference gray signal and the leakage current I_leak. When the bias circuit Ibias is configured to generate substantially the same current as the reference current Iref, a voltage corresponding to the difference current Idif=Iref'=I_leak−Iref may be stored in the second capacitor C2. Finally, the voltage output from the comparator COMP corresponds to the difference value Deg=Iref'−Iref between the voltage stored in the first and second capacitors C1 and C2. The degree of degradation of the pixel may be determined by the difference value Deg. For example, when the value of Deg is a negative value, the pixel current Iref' flowing in the transistor M2 is decreased by the data signal of the reference gray signal, which means that degradation of the pixel is increased.

As such, an accurate pixel current may be measured regardless of the leakage current, and as a result, the degradation of the pixel may be accurately detected.

Figure 5:
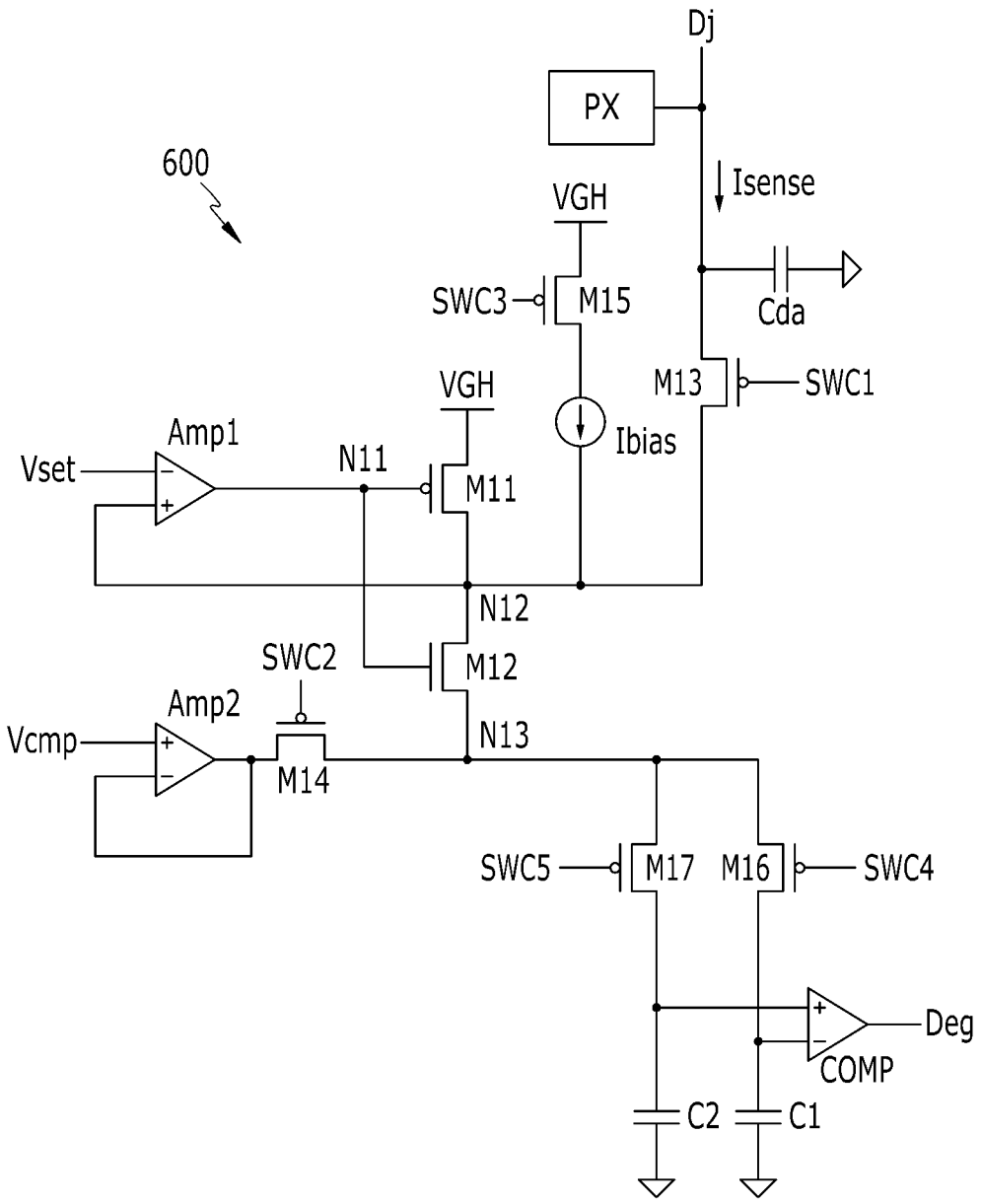
FIG. 5 is a circuit diagram illustrating a compensation unit according to another exemplary embodiment.

FIG. 5 is a circuit diagram illustrating a deterioration compensating unit according to another exemplary embodiment.

In contrast to the embodiment of FIG. 4, the fifth transistor M15 and the bias circuit Ibias included in the compensation unit 600 are connected between the high level voltage VGH and the second node N12.

The fifth transistor M15 includes a gate electrode receiving a third switching control signal SWC3, one electrode connected to the high level voltage VGH, and another electrode connected to the bias circuit Ibias.

The bias circuit Ibias is connected between the fifth transistor M15 and the second node N12 and when the fifth transistor M15 is turned on, a predetermined current amount flows from the high level voltage VGH to the second node N12.

Since other constituent elements are the same as those described in FIG. 4, detailed descriptions thereof will be omitted.

Next, the operation of the compensation unit 600 will be described.

For a first period, the second, fourth, and fifth switching control signals SWC2, SWC4, and SWC5 are applied as the gate-on voltage. In this case, the first and third switching control signals SWC1 and SWC3 are applied as the gate-off voltage. The first and second capacitors C1 and C2 are charged by the reset voltage Vcmp. The first period may be a period for resetting the first and second capacitors C1 and C2 to the reset voltage Vcmp.

For a second period, the second, fourth, and fifth switching control signals SWC2, SWC4, and SWC5 are applied as the gate-off voltage, and the first and third switching control signals SWC1 and SWC3 are applied as the gate-on voltage. In this case, the sensing signal SE[i] of the gate-on voltage may be applied to the gate electrode of the sensing transistor M3 included in the pixel PX connected to the data line Dj. As the first and third switching control signals SWC1 and SWC3 are turned on, the voltage of the second node N12 is set as the reference voltage Vset. The voltage of the second node N12 is stored in a parasitic capacitor Cda of the data line Dj. The reference voltage Vset may be a voltage lower than an operation point of the OLED included in the pixel PX. That is, the reference voltage Vset may be determined as a voltage having a level in which the OLED does not emit light.

For example, in the case where the voltage of the second node N12 is lower than the reference voltage Vset, a low level voltage is output from the first differential amplifier Amp1 to the first node N11. When the voltage of the first node N11 is the low level voltage, the first transistor M11 is turned on and current flows from the high level voltage VGH to the second node N12 through the turned-on first transistor M11. The voltage of the second node N12 rises by the current flowing through the first transistor M11. When the voltage of the second node N12 is higher than the reference voltage Vset, current flows from the second node N12 to the OLED of the pixel PX. In this case, since the reference voltage Vset is a voltage having a level in which the OLED does not emit light, the OLED does not emit light. That is, the current flows from the second node N12 to the second power voltage ELVSS connected to the cathode of the OLED, and the voltage of the second node N12 drops.

After the voltage of the second node N12 becomes the reference voltage Vset, and the parasitic capacitor Cda of the data line Dj is charged by the reference voltage Vset. The second period may be a period for pre-charging the parasitic capacitor Cda of the data line Dj by the reference voltage Vset.

For a third period, the first and fourth switching control signals SWC1 and SWC4 are applied as the gate-on voltage. In this case, the second, third and fifth switching control signals SWC2, SWC3, and SWC5 are applied as the gate-off voltage. The first capacitor C1 is charged by the leakage current I_leak. After a predetermined sampling period, the fourth switching control signal SWC4 is applied at the gate-off voltage and a charge corresponding to the leakage current I_leak is maintained in the first capacitor C1. The third period may be a period for charging the first capacitor C1 by the leakage current I_leak.

For a fourth period, the first, third, and fifth switching control signals SWC1, SWC3, and SWC5 are applied as the gate-on voltage and the reference voltage Vset is applied as a voltage at which the OLED emits light at a predetermined reference gray signal. In this case, the second and fourth switching control signals SWC2 and SWC4 are applied as the gate-off voltage. The sensing signal SE[i] of the gate-on voltage is applied to the gate electrode of the sensing transistor M3. The bias circuit Ibias generates substantially the same current as a reference current Iref flowing through the driving transistor M2 turned on by the data signal of the reference gray signal.

The reference current Iref flows from the high level voltage VGH to the second node N12 through the bias circuit Ibias. The pixel current Iref' at which the OLED emits light at the reference gray signal flows from the second node N12 toward the pixel PX. A difference current Idiff=Iref+I_leak−Iref,' which corresponds to the difference between the pixel current Iref' flowing toward the pixel PX from the second node N12 and the sum of the reference current Iref flowing to the second node N12 through the bias circuit Ibias and the leakage current I_leak of the data line Dj, flows to the third node N13 through the second transistor M12. As a result, the difference current Idiff is stored in the second capacitor C2. After a predetermined sampling period, the fifth switching control signal SWC5 is applies as the gate-off voltage and a charge corresponding to the difference current Idif is maintained in the second capacitor C2. The sampling periods of the third and fourth periods may be set to the same period. The fourth period may be a period for charging the second capacitor C2 by the difference current Idif.

For a fifth period, the difference value between the voltages stored in the first and second capacitors C1 and C2 is output as the degradation information Deg through the comparator COMP. The difference value is a voltage corresponding to a difference value (Deg=Iref'−Iref) between the voltages stored in the first and second capacitors C1 and C2. The degradation degree of the pixel may be determined by the difference value Deg. For example, when the Deg value is a positive value, the pixel current Iref' flowing in the driving transistor M2 is decreased by the data signal of the reference gray signal, which means that degradation of the pixel is increased.

As such, an accurate pixel current may be measured regardless of the leakage current, and as a result, the degradation of the pixel may be accurately detected.

Figure 6:
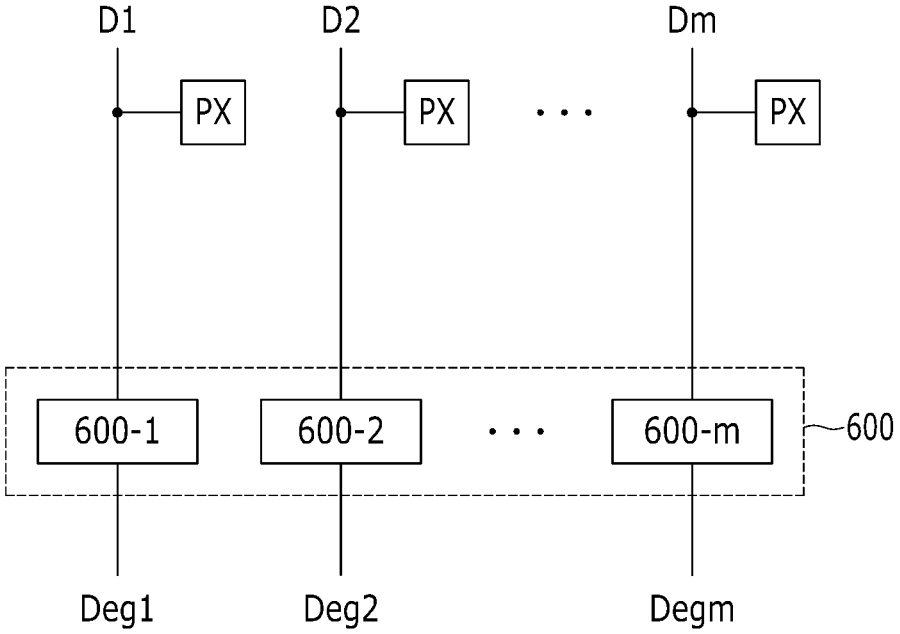
FIG. 6 is a block diagram illustrating a connection configuration of the compensation unit and a plurality of data lines according to an exemplary embodiment.

FIG. 6 is a block diagram illustrating a connection configuration of the deterioration compensating unit and a plurality of data lines according to an exemplary embodiment.

Referring to FIG. 6, the compensation unit 600 described in FIG. 4 or 5, includes a plurality of compensation units 600-1, 600-2, . . . , 600*m* to be respectively connected to a plurality of data lines D1 to Dm. The compensation units 600-1, 600-2, . . . , 600*m* may detect degradation information Deg1, Deg2, . . . , Degm of the pixels PX respectively connected to the data lines D1 to Dm.

Figure 7:
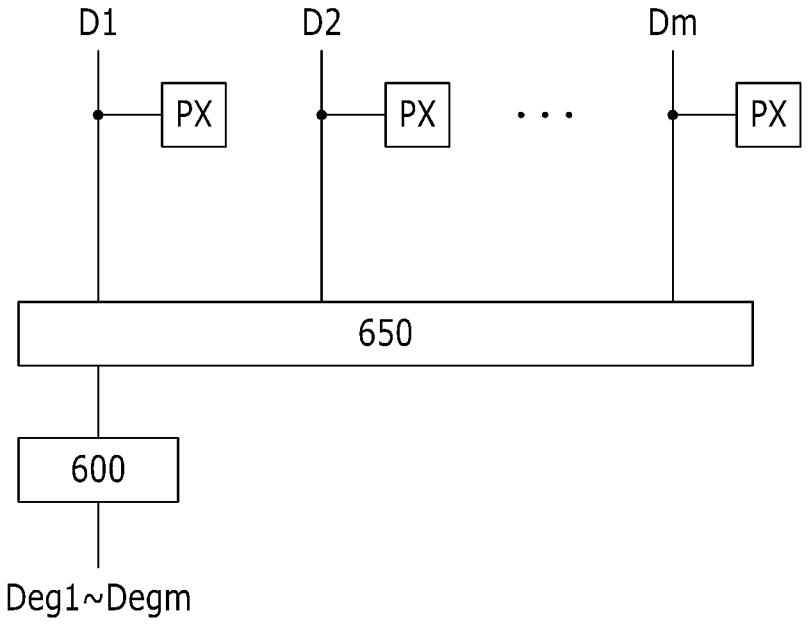
FIG. 7 is a block diagram illustrating a connection configuration of the compensation unit and a plurality of data lines according to another exemplary embodiment.

FIG. 7 is a block diagram illustrating a connection configuration of the deterioration compensating unit and a plurality of data lines according to another exemplary embodiment.

Referring to FIG. 7, one compensation unit 600 illustrated in FIG. 4 or 5 is provided and connected to a plurality of data lines D1 to Dm through a multiplexor (MUX) unit 650. The MUX unit 650 may selectively connect the compensation unit 600 to the data lines D1 to Dm. The compensation unit 600 is selectively connected to the data lines D1 to Dm through the MUX unit 650 and may detect the degradation information of the pixels PX respectively connected to the data lines D1 to Dm.

Figure 8:
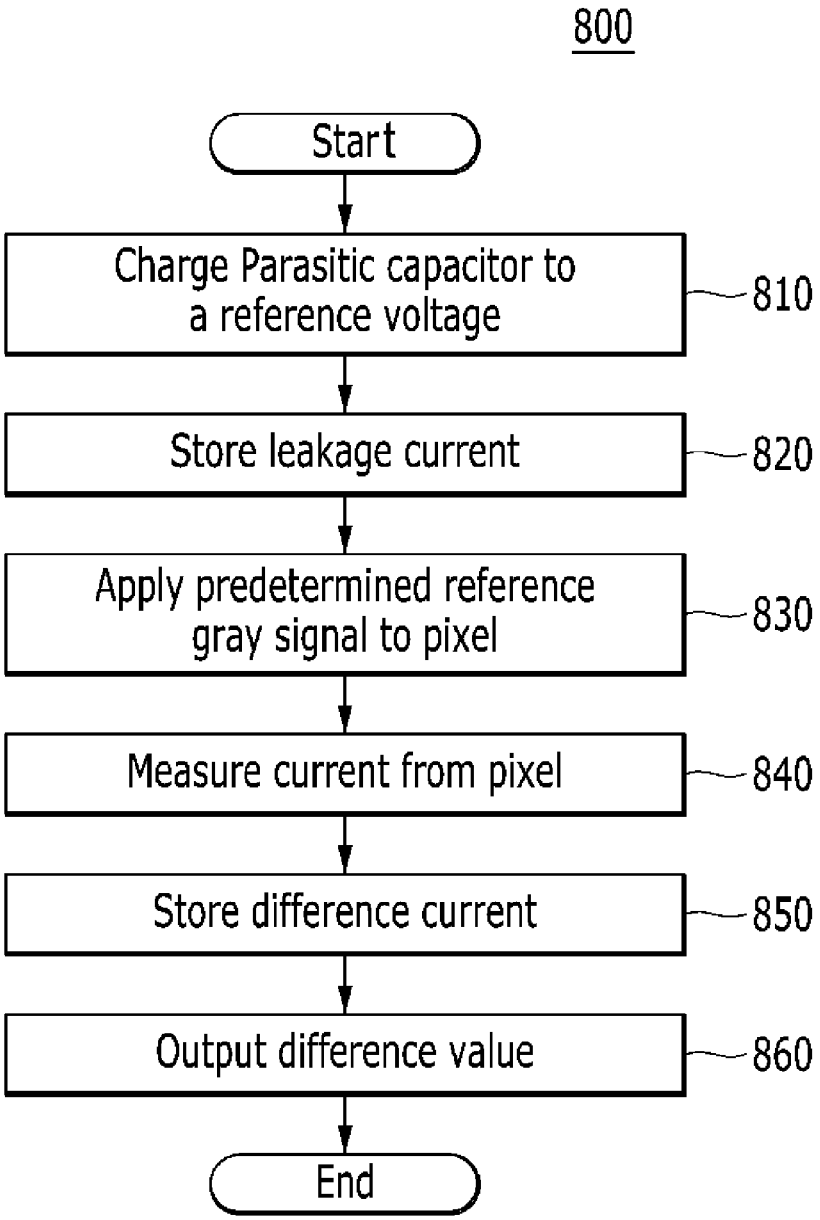
FIG. 8 is a flowchart illustrating an exemplary operation or procedure for driving an AMOLED display device according to an embodiment.

FIG. 8 is a flowchart showing an exemplary operation or procedure 800 for driving a display device according to one embodiment. Depending on the embodiment, additional states may be added, others removed, or the order of the states changed in FIG. 8. In state 810, the parasitic capacitor connected to a data line is charged to a reference voltage. In state 820, a leakage current flowing from the data line is stored in the first capacitor. In state 830, a data signal having a predetermined reference gray signal is applied to a pixel connected to the data line. In state 840, the current flowing from the pixel is measured while the predetermined reference gray signal is applied to the pixel. In state 850, a difference current is stored in the second capacitor. The difference current is defined as the difference between a reference current and the measured current. In state 860, a difference value is output. The difference value is defined as the difference between the voltages stored in the first and second capacitors.

In some embodiments, the procedure 800 is implemented in a conventional programming language, such as C or C++ or another suitable programming language. In one embodiment, the program is stored on a computer accessible storage medium of the display device. In another embodiment, the program is stored in a separate storage medium. The storage medium may include any of a variety of technologies for storing information. In one embodiment, the storage medium includes a random access memory (RAM), hard disks, floppy disks, digital video devices, compact discs, video discs, and/or other optical storage mediums, etc. In another embodiment, the signal controller 100 is configured to or programmed to perform at least part of the procedure 800. The program may be stored in the processor. In various embodiments, the processor may have a configuration based on, for example, i) an advanced RISC machine (ARM) microcontroller and ii) Intel Corporation's microprocessors (e.g., the Pentium family microprocessors). In one embodiment, the processor is implemented with a variety of computer platforms using a single chip or multichip microprocessors, digital signal processors, embedded microprocessors, microcontrollers, etc. In another embodiment, the processor is implemented with a wide range of operating systems such as Unix, Linux, Microsoft DOS, Microsoft Windows 7/Vista/2000/9x/ME/XP, Macintosh OS, OS/2, Android, iOS and the like. In another embodiment, at least part of the procedure 800 can be implemented with embedded software.

While the described technology has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An organic light-emitting diode (OLED) display device, comprising:

a plurality of pixels;

a plurality of data lines respectively connected to the pixels; and a compensation unit connected to at least one of the data lines, wherein the compensation unit includes:

a first capacitor configured to store a leakage current of a pixel connected to a corresponding data line;

a second capacitor configured to store a difference current, wherein the difference current is defined as the difference between: i) a reference current and ii) a current measured when a reference gray signal is applied to the pixel and received from the corresponding data line;

a comparator configured to output a voltage difference, wherein the voltage difference value is defined as the difference between the voltages stored in the first and second capacitors;

a fifth transistor including a gate electrode configured to receive a third switching control signal, a first electrode connected to a third node, to which the first and second capacitors are connected, and a second electrode; and a bias circuit connected between the second electrode of the fifth transistor and ground, wherein the bias circuit is configured to control a predetermined current to flow from the third node to the ground when the fifth transistor is turned on, wherein each pixel includes a driving transistor, wherein the driving transistor is configured to apply the reference current to the pixel, and wherein the predetermined current is substantially the same as the reference current.

2. The display device of claim 1, wherein the compensation unit further includes:

a first transistor including a gate electrode connected to a first node, a first electrode connected to a high level voltage, and a second electrode connected to a second node;

a second transistor including a gate electrode connected to the first node, a first electrode connected to the second node, and a second electrode connected to the third node; and a third transistor including a gate electrode configured to receive a first switching control signal, a first electrode connected to a corresponding data line, and a second electrode connected to the second node.

3. The display device of claim 2, wherein the first transistor is a p-channel field effect transistor and wherein the second transistor is an n-channel field effect transistor.

4. The display device of claim 2, wherein the compensation unit further includes a first differential amplifier including a first input terminal connected to the second node, a second input terminal configured to receive a reference voltage, and an output terminal connected to the first node.

5. The display device of claim 4, wherein the compensation unit further includes:

a fourth transistor including a gate electrode configured to receive a second switching control signal, a first electrode, and a second electrode connected to the third node; and a second differential amplifier including a first input terminal configured to receive a reset voltage, a second input terminal connected to the first electrode of the fourth transistor, and an output terminal connected the first electrode of the fourth transistor.

6. The display device of claim 5, wherein the compensation unit further includes a sixth transistor including a gate electrode configured to receive a fourth switching control signal, a first electrode connected to the third node, and a second electrode connected to the first capacitor.

7. The display device of claim 6, wherein the compensation unit further includes a seventh transistor including a gate electrode configured to receive a fifth switching control signal, a first electrode connected to the third node, and a second electrode connected to the second capacitor.

8. The display device of claim 7, wherein the comparator includes:

a first input terminal connected to the second capacitor;

a second input terminal connected to the first capacitor; and an output terminal configured to output the voltage difference value.

9. The display device of claim 8, wherein the compensation unit further includes:

a fifth transistor including a gate electrode configured to receive a third switch control signal, a first electrode connected to the high level voltage, and a second electrode; and a bias circuit connected between the second electrode of the fifth transistor and the second node, wherein the bias circuit is configured to control a predetermined current to flow from the high level voltage to the second node when the fifth transistor is turned on.

10. The display device of claim 9, wherein each pixel includes an organic light-emitting diode (OLED) having an operation point at which the OLED begins to emit light and wherein the reference voltage is a voltage lower than the operation point of the OLED included in the pixel.

11. The display device of claim 1, wherein each pixel includes an organic light-emitting diode (OLED) having an operation point at which the OLED begins to emit light and wherein the reference voltage is a voltage corresponding to the operation point of the OLED included in the pixel.

12. The display device of claim 11, wherein the compensation unit comprises a plurality of compensation units respectively connected to the data lines.

13. The display device of claim 1, further comprising a multiplexor (MUX) configured to selectively connect the compensation unit to each of the data lines.

14. A display device, comprising:

a plurality of pixels;

a plurality of data lines respectively connected to the pixels;

a compensation unit connected to at least one of the pixels and configured to output degradation information; and a signal controller configured to control the pixels based at least in part on the degradation information;

wherein the compensation unit is further configured to measure a leakage current and a difference current of the pixel via one of the data lines, wherein the difference current is defined as the difference between a reference current and a current of the pixel measured when a data signal having a predetermined gray is applied to the pixel, wherein the compensation unit is further configured to generate the degradation information based on at least one of the leakage current or the difference current, and wherein the compensation unit comprises:

a first capacitor configured to store the leakage current;

a second capacitor configured to store the difference current;

a comparator configured to compare the leakage current and the difference current, and output the difference as the degradation information;

a fifth transistor including a gate electrode configured to receive a third switching control signal, a first electrode connected to a third node, to which the first and second capacitors are connected, and a second electrode; and a bias circuit connected between the second electrode of the fifth transistor and ground, wherein the bias circuit is configured to control a predetermined current to flow from the third node to the ground when the fifth transistor is turned on, wherein each pixel further includes a driving transistor, wherein the driving transistor is configured to apply the reference current to the pixel, and wherein the predetermined current is substantially the same as the reference current.

15. The display device of claim 14, wherein the compensation unit further includes:

a first transistor including a gate electrode connected to a first node, a first electrode connected to a high level voltage, and a second electrode connected to a second node;

a second transistor including a gate electrode connected to the first node, a first electrode connected to the second node, and a second electrode connected to the third node; and a third transistor including a gate electrode configured to receive a first switching control signal, a first electrode connected to a corresponding data line, and a second electrode connected to the second node, wherein the first and second capacitors are connected to the third node.

* * * * *